US006112775A

United States Patent [19]

Hossli et al.

[11] Patent Number: 6,112,775

[45] Date of Patent: Sep. 5, 2000

[54] WEFT YARN SELECTION MECHANISM AND METHODS FOR WEAVING SEAT BELT WEBBING

[75] Inventors: Roland Hossli, South Hill; Timothy Mark Russell, Bracy, both of Va.

[73] Assignee: Narricot Industries Incorporated, Southampton, Pa.

[21] Appl. No.: 09/263,444

[22] Filed: Mar. 5, 1999

[51] Int. Cl.[7] ..... D03D 47/42

[52] U.S. Cl. ..... 139/383 R; 297/468; 139/384 R; 139/432; 139/22

[58] Field of Search ..... 139/384 R, 432, 139/22, 383 R; 297/468

[56] References Cited

U.S. PATENT DOCUMENTS

| | | | |
|---|---|---|---|
| 4,174,738 | 11/1979 | Berger et al. . | |
| 4,313,473 | 2/1982 | Reiter . | |
| 4,421,142 | 12/1983 | Muller | 139/383 R |
| 4,531,554 | 7/1985 | Muller et al. | 139/432 |
| 4,981,161 | 1/1991 | Pickering et al. | 139/383 R |
| 5,127,443 | 7/1992 | Ducamp et al. | 139/22 |
| 5,299,603 | 4/1994 | Reiter . | |
| 5,769,130 | 6/1998 | Brielmann | 139/22 |

*Primary Examiner*—Andy Falik
*Attorney, Agent, or Firm*—Akin, Gump, Strauss, Hauer & Feld, L.L.P.

[57] ABSTRACT

A needle loom having a weft yarn selection mechanism for automatic selection of a desired weft yarn from two or more weft yarns for insertion through a shed includes a needle having a yarn carrying end. A guard is located on the needle, with the guard having a closed front end at a position corresponding to the yarn carrying end of the needle, and extending generally along the length of the needle. A space is provided between the guard and the needle which is adapted to receive the two or more weft yarns. A selection mechanism is associated with at least one of the two or more weft yarns. The selection mechanism includes a weft yarn guide which is movably mounted to displace an associated one of the two or more weft yarns between a standby position, in which the associated yarn remains on a needle insertion side of the shed in a position between the needle and the guard as the needle moves across the shed opening, and a selected position, in which the yarn carrying end of the needle is adapted to engage the associated weft yarn as the needle moves across the shed opening to carry the associated weft yarn across the shed. A method for weaving seat belt webbing utilizing the needle loom with the weft yarn selection mechanism and the weft carrying needle having a guard is also provided.

15 Claims, 6 Drawing Sheets

WEFT YARN SELECTION MECHANISM AND METHODS FOR WEAVING SEAT BELT WEBBING

BACKGROUND OF THE INVENTION

Briefly stated, the present invention relates to seat belt webbing, and more particularly to an improved method for manufacturing seat belt webbing having both high lateral stiffness and specialty edging. Seat belt (also called safety belt) systems have evolved significantly as these systems have become standard equipment in all types of automotive vehicles. Different designs of seat belts have been provided for various types of systems, depending upon the properties desired. Automobile manufacturers may specify a preference for one desirable property over another, and certain automobile designs suggest that a desirable webbing would have a round or other specialty edge to provide added passenger comfort. Sometimes, automobile manufacturers may specify a round or other specialty edge in conjunction with webbing having a high lateral stiffness. The lateral stiffness is desirable because it can help prevent roping or twisting of the seat belt, such as within the "D" ring upon extraction or retraction which could lead to a malfunction of the seat belt system.

One means to provide high lateral stiffness is to manufacture a seat belt webbing using two different types of weft yarns, such as multifilament and monofilament yarns. Several designs and processes presently exist for the manufacture of this type of product; however, these designs and processes insert both types of weft yarns simultaneously through the shed. These designs and processes can be difficult to manufacture and to maintain good quality control because the tension relationship between two weft yarns, the catch cord yarn, and the lock stitch yarn is critical to the proper formation of the webbing's edges. This is especially true at high manufacturing speeds and thus has an impact on the performance of the manufacturing equipment. The present invention, whereby two groups of weft yams are inserted on alternate passes or picks rather than inserted in the same pick, yields a webbing that is easier to manufacture because the resultant weft and warp tensions are not as critical to the formation of a round or other specialty edge as compared to existing methods, especially when used with larger denier weft yarns which are more difficult to fold into a round edge at high manufacturing speeds. This results in fewer manufacturing defects.

BRIEF SUMMARY OF THE INVENTION

Briefly stated, the present invention provides a needle loom having a weft yarn selection mechanism for automatic selection of a desired weft yarn from two or more weft yarns for insertion through a shed. The needle loom includes a weft insertion needle having a yarn carrying end. A guard is located on the needle, with the guard having a closed front end at a position corresponding to the yarn carrying end of the needle., and extending generally along the length of the needle. A space is provided between the guard and the needle which is adapted to receive the two or more weft yarns. A selection mechanism is associated with at least one of the two or more weft yarns. The selection mechanism includes a weft yarn guide which is movably mounted to displace an associated one of the two or more weft yarns between a standby position, in which the associated yarn remains on a needle insertion side of the shed in a position between the needle and the guard as the needle moves across the shed opening, and a selected position, in which the yarn carrying end of the needle is adapted to engage the associated weft yarn as the needle moves across the shed opening to carry the associated weft yarn across the shed.

In another aspect, the present invention provides a method of weaving seat belt webbing having a specialty edge. The method comprises the steps of:

(a) providing a plurality of warp yarns in a shedding arrangement for producing a shed, the plurality of warp yarns including a ground group of warp yarns, a first edge group of warp yarns on one side of the ground group of warp yarns and a second edge group of warp yarns on an opposite side of the ground group of warp yarns;

(b) providing first and second groups of weft yarns, the first group of weft yarns having at least one property different from the second group of weft yarns;

(c) singly inserting and controlling tension of a weft yarn of the first group for weaving with the ground group and the edge groups of warp yarns;

(d) engaging the weft yarn of the first group with a stitching yarn on a second side of the shed;

(e) singly inserting and controlling tension of a weft yarn from the second group in a separate shed from the weft yarn of the first group for weaving with the ground group of warp yarns; and (f) engaging the weft yarn of the second group with a stitching yarn on the second side of the shed, forming a woven seat belt webbing having specialty edges without weft yarns from the second group extending on either side of the ground group of warp yarns.

In another aspect, the present invention provides a method of weaving seat belt webbing having a specialty edge. The method comprises:

(a) providing a needle loom having a weft yarn selection mechanism for automatic selection of a desired weft yarn from at least first and second weft yarns for insertion through a shed of warp yarns, the needle loom including a needle having a yarn receiving end, a guard associated with needle, the guard being closed at a front position corresponding to the yarn receiving end of the needle and extending generally along the needle, with a space being provided between the guard and the needle which is adapted to receive the at least first and second weft yarns, and a selection mechanism associated with the first and second weft yarns, the selection mechanism including a weft yarn guide which is movably mounted to displace an associated one of the at least first and second weft yarns between a selected position, in which the yarn receiving end of the needle is adapted to engage the associated weft yarn as the needle moves across the shed opening to carry the associated weft yarn across the shed, and a standby position, in which the associated yarn remains on a first side of the shed in a position between the needle and the guard as the needle moves across the shed opening;

(b) activating the selection mechanism for the first weft yarn and engaging the first weft yarn with the yarn receiving end of the needle to carry the first weft yarn across the shed to a second side of the shed;

(c) engaging the first weft yarn with a stitching yarn on the second side of the shed and returning the needle to the first side of the shed, carrying the first yarn out of the shed;

(d) activating the selection mechanism for the second weft yarn and engaging the second weft yarn with the yarn receiving end of the needle to carry the second weft yarn across the shed to a second side of the shed; and (e) engaging the second weft yarn with the stitching yarn on the second side of the shed and returning the needle to the first side of the shed, carrying the second yam out of the shed.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For purpose of illustrating the invention, there are shown in the drawings embodiments that are presently preferred. It should be understood, however, that the invention is not limited to the precise arrangements and instrumentalities shown. In the drawings.

DETAILED DESCRIPTION OF THE INVENTION

Figure 1:
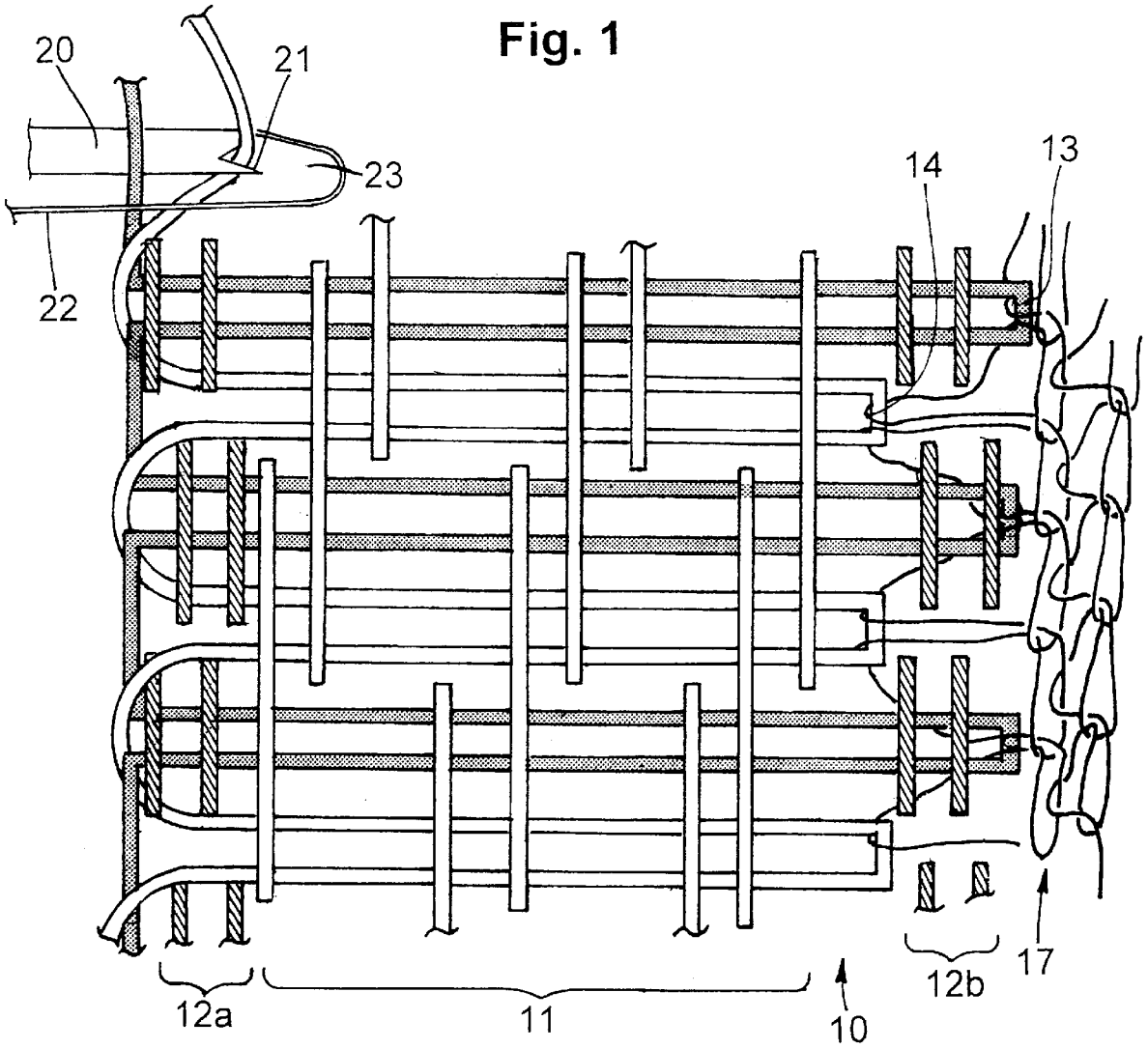
FIG. 1 is a schematic illustration of a top plan view of an exemplary seat belt webbing in accordance with the present invention.

Certain terminology is used in the following description for convenience only and is not limiting. The words "left", "right", "lower", and "upper" designate directions in the drawings to which reference is made. The words "inwardly" and "outwardly" refer to directions toward and away from, respectively, the geometric center of the seat belt webbing in accordance with the present invention and designated parts thereof. The terminology includes the words specifically mentioned above, derivatives thereof and words of similar import.

Figure 2A:
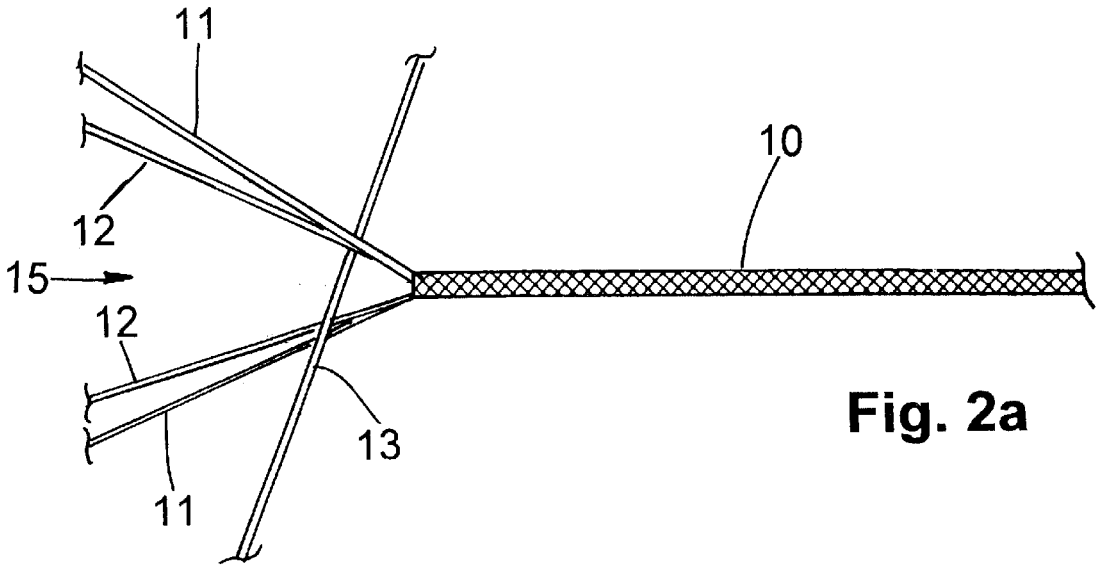
FIG. 2*a* is a schematic illustration showing the insertion of a weft yarn of the first weft yarn group.
Figure 2B:
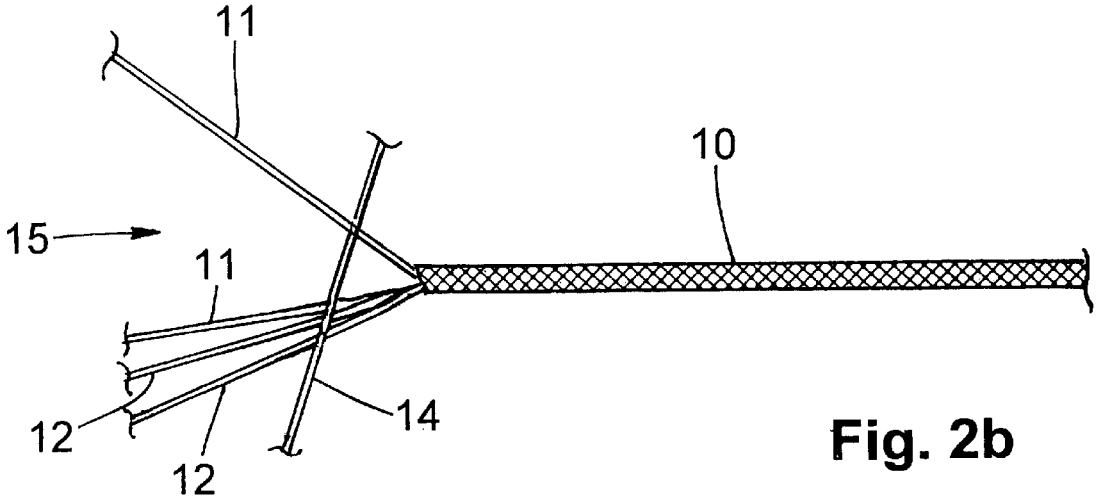
FIG. 2*b* is a schematic illustration showing the insertion of a weft yarn of the second weft yam group.

Referring now to FIG. 1, a schematic illustration of a seat belt webbing 10 in accordance with the present invention is shown as it is being woven in a needle loom. The seat belt webbing 10 includes a plurality of warp yarns 11, 12 that are interwoven with a plurality of weft yarns 13, 14 that are inserted through a shed 15 (shown in FIGS. 2*a* and 2*b*) in the warp yarns 11, 12, as shown in FIGS. 2*a* and 2*b*. The warp yarns 11, 12 include a ground group and first and second edge groups 12*a*, 12*b* (which are referred to generally as 12). First and second groups of weft yarns 13, 14 are provided. While the weft yarns 13, 14 within each group may in fact each be a continuous strand, as used herein and as understood by those of ordinary skill in the art, the term "weft yarn" refers to each pass of the weft yarn across the shed.

Figure 3A:
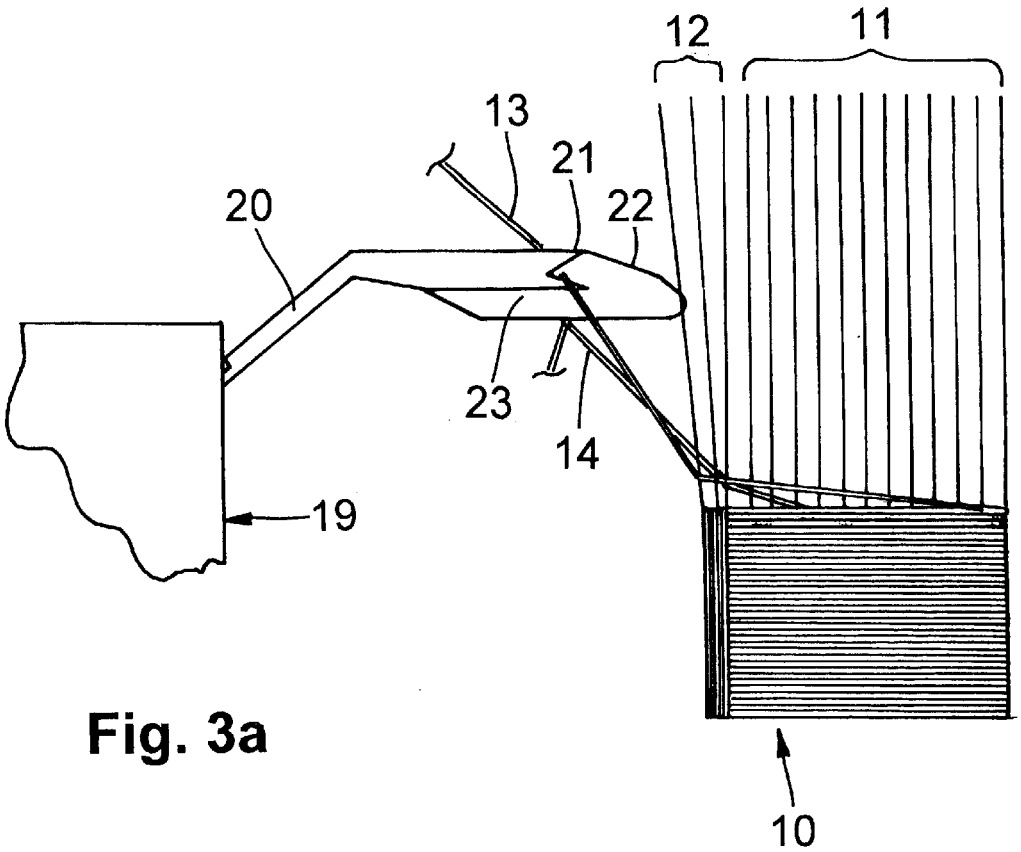
FIG. 3*a* is a schematic illustration of a top plan view similar to FIG. 1 showing the weft needle of the present invention inserting the weft yarn of the first group.
Figure 3B:
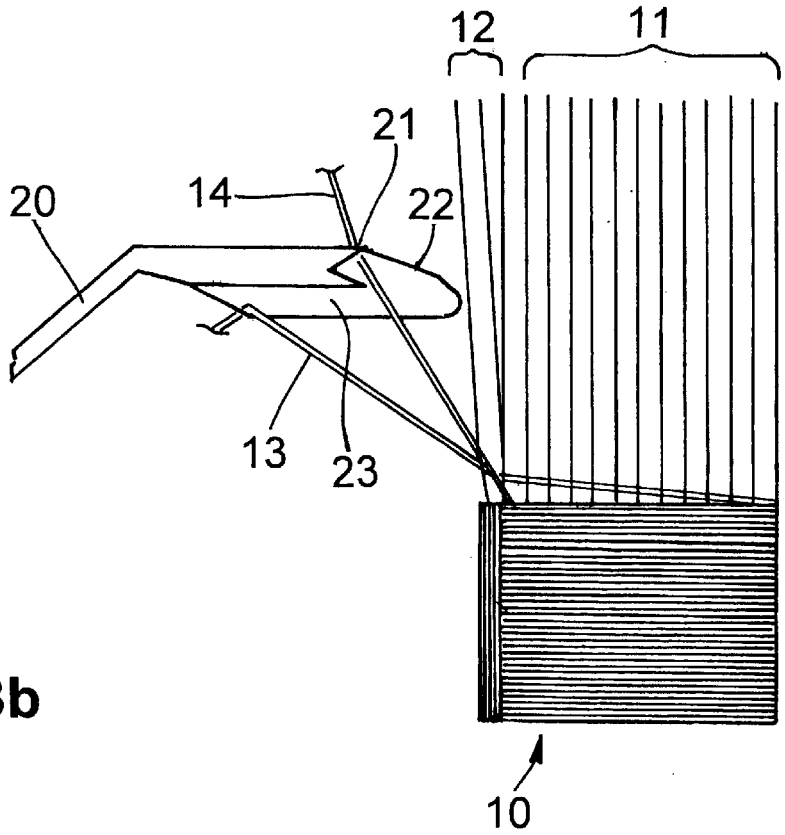
FIG. 3*b* is a schematic illustration of a top plan view similar to FIG. 3*a* showing the weft needle of the present invention inserting the weft yarn of the second group.

As shown in FIGS. 3*a* and 3*b*, the seat belt webbing 10 is preferably woven on a conventional needle loom 19, such as a Jacob Mueller Model NC, ND, NF or NG, whch has been modified to include a weft needle 20 and a weft yam selection mechanism 30 (shown in FIG. 4*a*) for automatic selection of a desired weft yarn 13, 14 from two or more weft yarns for insertion through a shed 15. The needle 20 includes a yarn carrying end 21 which is preferably a forked tip which is adapted to engage the weft yarn 13, 14 in the ted position as the needle 20 is inserted into the shed 15, as explained in detail below. A guard 22 is located on the needle 20. The guard 22 includes a closed front end at a position corresponding to the yarn carrying end 21 of the needle 20, and extends generally along the length of the needle 20. Preferably the guard 22 is connected to the needle 20 at both ends of the guard 22. A space 23 is provided between the guard 22 and the needle 20 which is adapted to receive the two or more weft yarns 13, 14. The guard 22 prevents loose warp ends 11, 12 from being caught on the weft needle 20 and enables the weft yarns 13, 14 to be exactly positioned into the forked tip 21 of the needle 20 at the proper time by the weft yarn selection mechanism 30, thus permitting the loom 19 to operate at a faster, more efficient speed with fewer defects. While a Jacob Muller loom is used in connection with the preferred embodiment of the invention, it will be recognized by those skilled in the art from the present disclosure that other looms from other manufacturers could also be modified to utilize the weft yarn selection mechanism 21 and weft needle 20 of the present invention, and the invention is not limited to a particular type of needle loom.

Figures 4A, 4B:
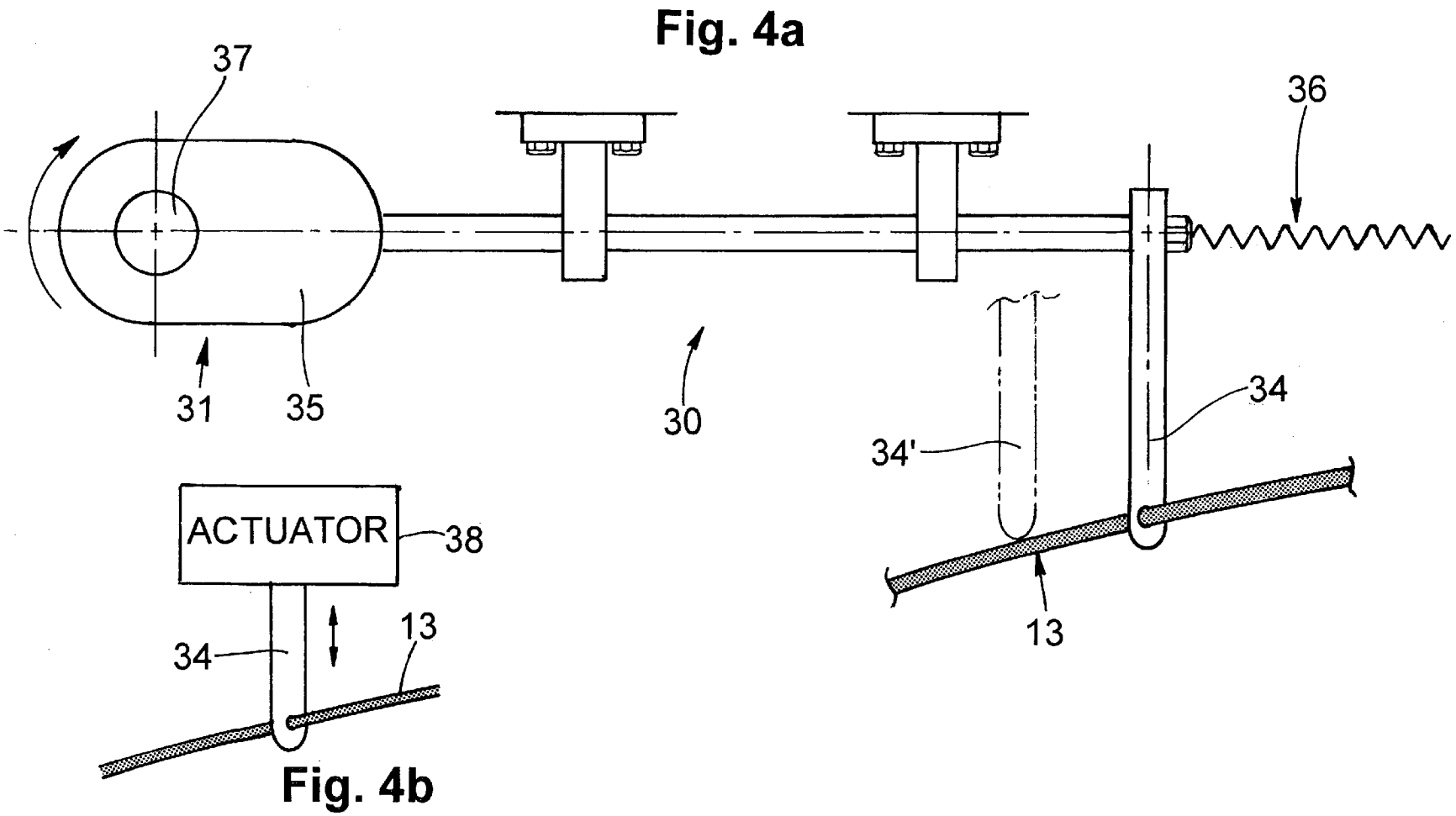
FIG. 4*a* is a schematic illustration of a weft yarn selection mechanism in accordance with the present invention.
FIG. 4*b* is a schematic illustration of an alternative weft yarn selection mechanism in accordance with the present invention.

As shown in FIG. 4*a*, a selection mechanism 30 is associated with at least one of the two or more weft yarns 13, 14. In the preferred embodiment, a weft yarn selection mechanism 30 is associated with each of the weft yarns 13, 14, and while this only requires two weft yarn selection mechanisms, it will be recognized by those skilled in the art from the present invention that multiple weft yarn selection mechanisms 30 can be utilized. The selection mechanism 30 includes a weft yarn guide 34 which is movably mounted to displace an associated one of the two or more weft yarns 13, 14 between a standby position, shown in phantom lines as 34' in FIG. 4, in which the associated weft yarn 13, 14 remains on a needle insertion side of the shed 15 in a position between the needle 20 and the guard 22 as the needle 20 moves across the shed opening, and a selected position, in line with the path of the forked tip 21 of the needle 20, such that the yarn carrying end 21 of the needle 20 is adapted to engage the associated weft yarn 13, 14 as the needle 20 moves across the shed opening 15 to carry the associated weft yarn 13, 14 across the shed 15.

In the preferred embodiment, the movable yarn guide 34 is connected to a displacement mechanism 31 which moves the yarn guide 34 between the standby and the selected positions of the weft yarns 13, 14. As shown in FIG. 4*a*, in the preferred embodiment, the displacement mechanism 31 is a cam driven arrangement and is driven by a rotating cam 35 connected to a shaft 37 on one end and which is secured at the other end to the needle loom 19 by a spring 36. The rotating cam 35 causes the yarn guide 34 to move up and down and thereby cause the associated weft yarn 13, 14 to be positioned in the path of the forked tip 21 of the needle 20 at the proper time. In the preferred embodiment, two weft yarn selection mechanisms 30 are used, and cams 35 are positioned such that one yarn guide 34 is in the up position while the second yarn guide (not shown) is in the down position, thereby causing only the first group of weft yarns 13 or the second group of weft yarns 14 to be positioned in the path of the needle 20 at the same time. Depending upon the weave pattern desired, and upon the yarns comprising the weft yarns 13 of the first group and the weft yarns 14 of the second group, at least one weft yarn selection mechanism 30 will be used. It is also possible to have each of the weft yams 13 of the first group use one weft yarn selection mechanism 30 and/or have each of the weft yarns 14 of the second group use one weft yarn selection mechanism 30. It will be recognized by those skilled in the art from the present disclosure that the displacement mechanism 31 need not be a cam, and may comprise a pneumatic or electromagnetic actuator 38 (shown in FIG. 4*b*) for moving the yarn guide 34. It will be similarly recognized by those skilled in the art that the standby position of the yarn guide 34 can be either up or down and the insertion position can be either up or down, as desired. It is also possible to utilize only one weft yarn selection mechanism 30 such that the weft yams of one group are inserted in every pick, and the weft yarns of the other group are controlled by the weft yarn selection mechanism and are only inserted in selected picks, such as every other pick.

Figure 5A:
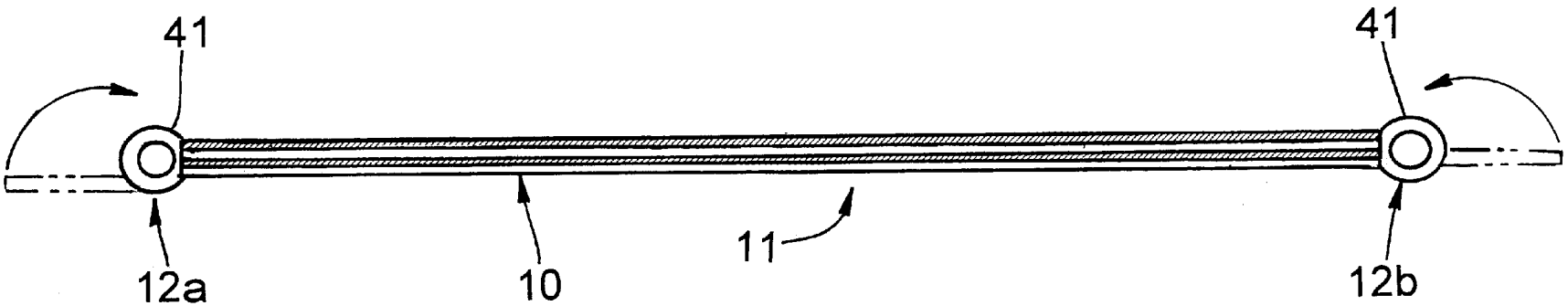
FIG. 5*a* is a cross-sectional view showing a seat belt webbing having tubular edges produced in accordance with the present invention.

In the preferred embodiment, the modified needle loom 19 in accordance with the present invention is utilized for weaving seat belt webbing 10 having a specialty edge. As shown in FIGS. 2*a*, 2*b*, 3*a* and 3*b*, the warp yarns 11, 12 are provided in a shedding arrangement for producing the shed 15, with the warp yams 11 being provided in the ground group, and the first and second edge groups 12*a*, 12*b*. The first and second groups of weft yarns 13, 14 are provided, with the first group of weft yarns 13 having at least one property different from the second group of weft yarns 14. In the preferred embodiment for forming a seat belt webbing with round or tubular edges 41, as shown in FIG. 5*a*, the second group of weft yarns 14 have a higher yarn stiffness than the first group of weft yarns 13. This can be accomplished by various means such as by the use of monofilament yarn, however it will be recognized by those skilled in the art from the present disclosure that other yarns with high stiffness may also be used. As shown in FIGS. 2*a* and 3*a*, a weft yarn 13 of the first group is inserted through the shed 15 for weaving with the warp yarns 11 of the ground group and the warp yarns 12 of the edge groups 12*a*, 12*b* using the needle 20, allowing control of the weft yarn tension independently from the weft yarns 14 of the second group. The weft yarn 13 of the first group is engaged with a stitching yarn 17 on the second side of the shed 15. The needle 20 is then withdrawn from the shed 15 back to the first side, with the weft yarn 13 of the first group being carried out by the guard 22. The shed 15 is changed for the next weft yarn. The weft yarn selection mechanism 30 for the second weft yarn 14 is actuated, moving the weft yarn 14 from the second group into the path of the forked tip 21 of the needle 20, and in the preferred embodiment for forming a round edge, crossing the weft yarn 14 of the second group with the weft yarn 13 of the first group on the first side of the shed 15, as shown in FIGS. 1 and 2*b*. The weft yarn 14 of the second group is then inserted in a separate shed 15, as shown in FIG. 3*b*, from the weft yarn 13 of the first group for weaving with the ground group of warp yarns 11. This allows independent control of the tension on the weft yarns 14 of the second group. The weft yarn 14 of the second group is engaged with the stitching yarn 17 on the second side of the shed 15 to form a seat belt webbing 10 having a specialty edge, and preferably round edges 41. As shown in FIG. 5*a*, by controlling the weft yarn tension of the second group of warp yarns 14, the outside edges of the webbing 10 are folded over seamlessly to the edges of woven fabric formed by the ground group of warp yarns 11, as described in detail below. In the preferred embodiment, the weft yarns 13 of the first group are woven singly with the warp yarns 11, 12 in alternate sheds 15 from the weft yarns 14 of the second group. However, it will be recognized by those skilled in the art from the present disclosure that the weave pattern and selection of the insertion of the weft yarns 13, 14 from the first and second groups, as well as the possibility of additional groups of weft yarns are possible in accordance with the present invention.

In the preferred embodiment, to form round or tubular edges 41, the weft yarn 13 of the first group is engaged in the tip 21 of the weft needle 20 and traverses the width of the shed opening, where they are secured on the edge portion of the webbing by a standard Mueller System 3 or System 5 knitted edge configuration. The weft needle 20 then returns to the first side and exits the shed opening, and the warp yarns 12 in the edge groups 12*a*, 12*b* are then lowered relative to the warp yarns 11 in the main group. On the next pass, as shown in FIG. 3*b*, the weft yarn 14 of the second group is engaged in the tip 21 of the weft needle 20. The two weft yarns 13, 14 are crossed and the weft yarn 14 of the second group is inserted into the shed opening. The weft needle 20 traverses the width of the shed opening and the weft yarn 14 of the second group is secured by the continuation of the Mueller System 3 or System 5 knitted edge configuration. This continuation of the weft insertion into the lower and then into the upper part allows the knitted edge to fold over seamlessly to form a round edge without exerting excessive tension to fold the edges over.

In the preferred embodiment of the present invention, the webbing 10 is woven on the needle loom 19 of the present invention with the needle 20 and the weft yarn selection mechanism 30. As a result of this method of manufacture, a knitted edge is formed along one edge or at the seam of the round edge of the webbing. The edge formation provides for an effective and efficient production of the webbing, and the edge knitting according to the invention is practiced by knitting either one or more catch cord and/or lock stitch yarns at the edge portion. The tension is controlled on the locking yarns to ensure a uniform edge, such as a Mueller System 3 or System 5 edge. However, is will be recognized by those skilled in the art from the present disclosure, that depending upon the loom utilized, or upon the customer's specification, a locking yarn may not be required along one edge of the webbing to hold the weft yarns in place.

In the preferred embodiment, the edge portions formed by the edge groups 12*a*, 12*b* of warp yarns 12 and the first group of weft yarns 13 are of a linen weave. The linen weave is attached to one side of the ground group warp yarns 11 by a weft yarn 13 from the first group, and on the subsequent pick the outside of the linen weave edge portion is folded and attached to the ground group of warp yarns 11 by a weft yarn 14 from the second group. This is accomplished by crossing the weft yarn 13 of the first group with the weft yarn 14 of the second group as the weft yarn 13 of the first group exits the linen weave edge portion. The body of the webbing is preferably a twill weave. However it will be recognized by those skilled in the art from the present disclosure that any desirable weave pattern suitable for automotive seat belt webbing can be utilized for the ground and edge groups of warp yarns 11, 12.

It will be recognized by those skilled in the art that the present invention is not limited to any particular weave pattern or any particular types of warp or weft yarns. The warp and weft yarns may be either single or multiple ply yarns of any given denier, and may be twisted or untwisted. The first group of weft yarns 13 and the second group of weft yarns 14 may be comprised of the same type of yarn, or of different types of yarns, and the first group and/or the second group of weft yarns 13, 14 may be comprised of one or more types of yarn, including an embodiment whereby the first group of weft yarns 13 is comprised of a multifilament yarn and the second group of weft yarns 14 is comprised of a multifilament yarn and a monofilament yarn. The deniers of the warp and weft yarns 11, 12, 13, 14, and the total number of different types of weft yarns 13, 14, are preferably chosen depending upon the type of yarns used and the customer's webbing performance specification. So long as there are two groups of weft yarns 13, 14, and the weft yarns 13 of the first group and the weft yarns 14 of the second group are inserted on alternate picks, it will be recognized by those skilled in the art that the present invention yields a webbing that is easier to manufacture because the resultant weft and warp tensions are not as critical to the formation of the round or other specialty edge as compared to existing methods, especially when used with larger denier weft yarns which are more difficult to fold into a round edge at high manufacturing speeds.

Figure 5B:
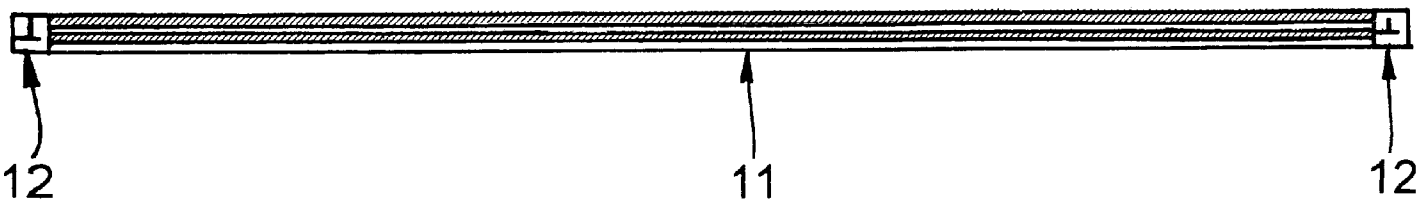
FIG. 5*b* is a cross-sectional view showing a seat belt webbing having mock edges produced in accordance with the present invention.

Preferably, the warp yarns 11 of the ground group are single ply polyester having a denier of about 1300. The warp yarns 12 of the edge groups 12*a*, 12*b* are single ply polyester having a denier of about 500. The weft yarn 13 of the first group is preferably a multifilament yarn comprised of polyester and having a denier of about 420, and the weft yarn 14 of the second group is preferably a monofilament yarn comprised of polyester and having a denier of about 600. The lock stitch yarn 17 and catch cord are preferably a polyester yarn having a denier of about 90 and 220, respectively. In the preferred embodiment, the webbing 10 is approximately two inches wide; however, the webbing 10 can be used in applications in which the width is preferably between one and four inches. It is also possible to make the webbing 10 in other narrower or wider sizes for various other applications. It is also possible to make the webbing 10 with additional features including, but not limited to, standard and high elongations. In addition to a round edge, other specialty edges such as a box edge, a covered edge and a mock self edge, as shown in FIG. 5*b* are possible. It is also possible to make the webbing without a specialty edge.

Figure 6:
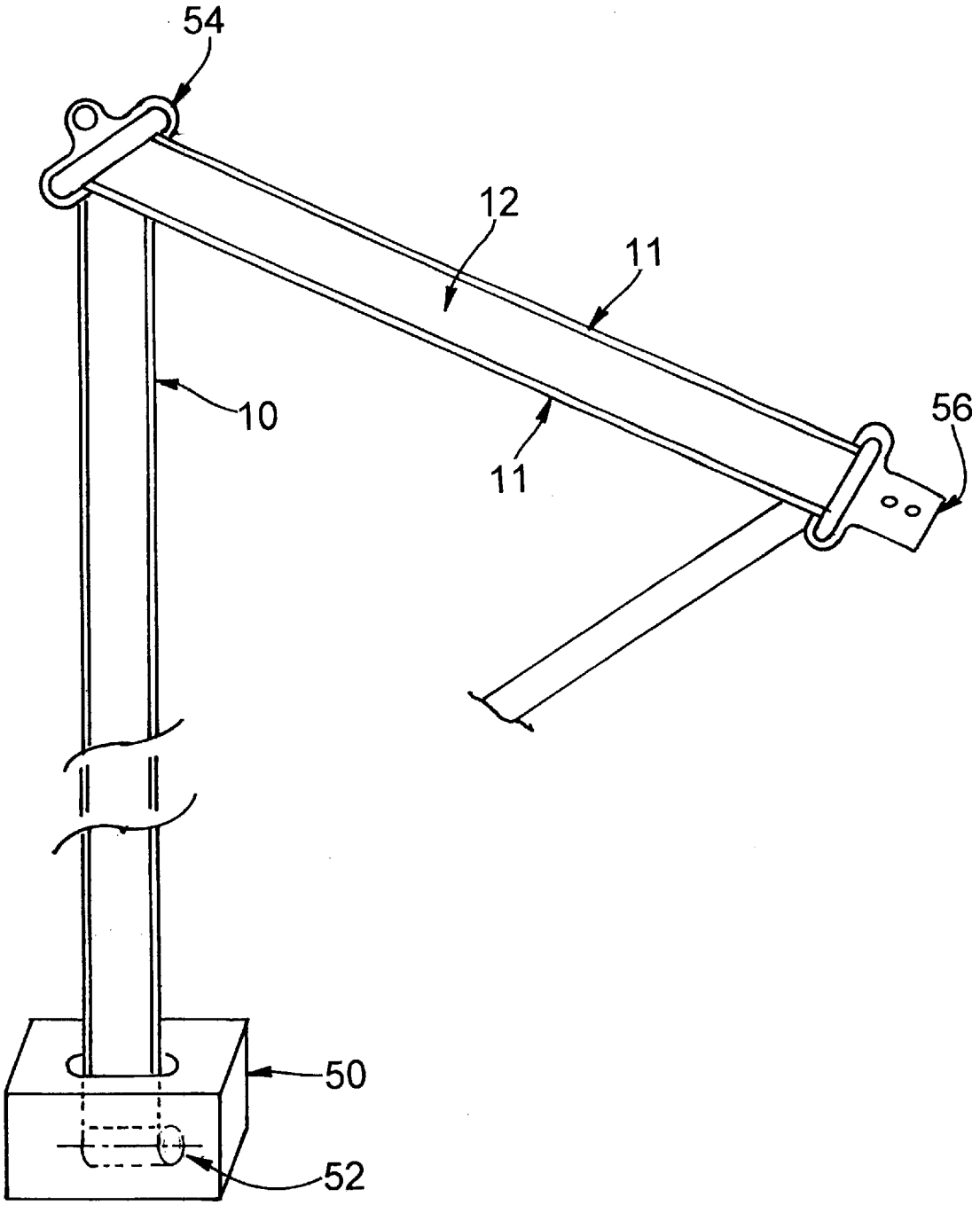
FIG. 6 is an elevational view of a seat belt system using the seat belt webbing in accordance with the present invention.

Referring to FIG. 6, a seat belt system is shown in detail and includes the seat belt webbing 10 which is provided on a winding mechanism 50 having a spool 52, with the seat belt webbing 10 being at least partially coiled on the spool 52. The shoulder harness guide member 54 is provided at a position generally corresponding to a user's shoulder, and the seat belt webbing 10 passes over the shoulder harness guide member 54 to redirect the seat belt webbing 10 which extends from the winding mechanism 50. A buckle member 56 is connected to the seat belt webbing 10 by passing through an opening in the buckle member 56, and the end of the seat belt webbing 10 is anchored in a fixed position (not shown). It will be recognized by those skilled in the art from the present disclosure that the seat belt webbing may be used in other types of retractable and/or non-retractable seat belt systems. As the seat belt webbing 10 is retracted onto the spool 52, the specialty edge such as a round edge 41 on the seat belt webbing 10 protects the passenger from the moving edge of the seat belt webbing 10.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A needle loom having a weft yarn selection mechanism for automatic selection of a desired weft yarn from two or more weft yarns for insertion through a shed, comprising:

a weft insertion needle having a yarn carrying end;

a guard located on the needle, the guard having a closed front end at a position corresponding to the yarn carrying end of the needle and extending generally along a length of the needle, with a space being provided between the guard and the needle which is adapted to receive the two or more weft yarns;

a selection mechanism associated with at least one of the two or more weft yarns, the selection mechanism including a weft yarn guide which is movably mounted to displace an associated one of the two or more weft yarns between a standby position, in which the associated yarn remains on a needle insertion side of the shed in a position between the needle and the guard as the needle moves across the shed opening, and a selected position, in which the yarn carrying end of the needle is adapted to engage the associated weft yarn as the needle moves across the shed opening to carry the associated weft yarn across the shed.

2. The needle loom of claim 1 wherein each said movable yarn guide is connected to a displacement mechanism which moves the yarn guide between the standby and the selected positions of the weft yarn.

3. The needle loom of claim 2 wherein the displacement mechanism is a cam driven arrangement.

4. The needle loom of claim 2 wherein the displacement mechanism is one of a pneumatic or electromagnetic actuator.

5. The needle loom of claim 1 wherein the yarn carrying end of the needle includes a forked tip which is adapted to engage the weft yarn in the selected position as the needle is inserted into the shed.

6. The needle loom of claim 1 wherein the guard is connected to the needle.

7. The needle loom of claim 1 wherein a separate selection mechanism is associated with each of the at least first and second weft yarns.

8. A method of weaving seat belt webbing having a specialty edge, comprising:

(a) providing a plurality of warp yarns in a shedding arrangement for producing a shed, the plurality of warp yarns including a ground group of warp yarns, a first edge group of warp yarns on one side of the ground group of warp yarns and a second edge group of warp yarns on an opposite side of the ground group of warp yarns;

(b) providing first and second groups of weft yarns, the first group of weft yarns having at least one property different from the second group of weft yarns;

(c) inserting from a first side of the shed and independently controlling tension of a weft yarn of the first group for weaving with the ground group and the edge groups of warp yarns;

(d) engaging the weft yarn of the first group with a stitching yarn on a second side of the shed;

(e) inserting from the first side of the shed and independently controlling tension of a weft yarn from the second group in a separate shed from the weft yarn of the first group for weaving with the ground group of warp yarns; and (f) engaging the weft yarn of the second group with a stitching yarn on the second side of the shed, forming a woven seat belt webbing having specialty edges without weft yarns from the second group extending on either side of the ground group of warp yarns.

9. The method of claim 8 further comprising the step of crossing the weft yarn of the second group with the weft yarn of the first group on a first side of the shed.

10. The method of claim 8 wherein the first group of weft yarns comprise a first continuous yarn and the second group of weft yarns comprise a second continuous yarn, and the first and second weft yarns are singly woven with the warp yarns by carrying the weft yarns across the shed in the warp yarns utilizing a single needle loom.

11. The method of claim 8 further comprising weaving the weft yarns of the first group with the warp yarns in alternate sheds from the weft yarns of the second group.

12. The method of claim 8 further comprising engaging the weft yarn of the first group with the needle and carrying the weft yarn of the first group across the shed with the needle, releasing the weft yarn of the first group from the needle, engaging the weft yarn of the second group with the needle, and carrying the weft yarn of the second group across a next shed with the needle.

13. The method of claim 8 further comprising providing a weft yarn selection mechanism for automatic selection of a desired weft yarn from the first and second weft yarns for insertion through the shed of warp yarns, the needle loom including a needle having a yarn receiving end, a guard connected to the needle having a closed front end at a location corresponding to the yarn receiving end of the needle and extending generally along the needle, with a space being provided between the guard and the needle which is adapted to receive the at least first and second weft yarns, and a selection mechanism associated with at least one of the at least first and second weft yarns, each said selection mechanism including a weft yarn guide which is movably mounted to displace an associated one of the at least first and second weft yarns between a selected position, in which the yarn receiving end of the needle is adapted to engage the associated weft yarn as the needle moves across the shed opening to carry the associated weft yarn across the shed, and a standby position, in which the associated yarn remains on a first side of the shed in a position between the needle and the guard as the needle moves across the shed opening.

14. A method of weaving seat belt webbing having a specialty edge, comprising:

(a) providing a needle loom having a weft yarn selection mechanism for automatic selection of a desired weft yarn from at least first and second weft yarns for insertion through a shed of warp yarns, the needle loom including a needle having a yarn receiving end, a guard associated with needle, the guard being closed at a front position corresponding to the yarn receiving end of the needle and extending generally along the needle, with a space being provided between the guard and the needle which is adapted to receive the at least first and second weft yarns, and a selection mechanism associated with each of the at least first and second weft yarns, the selection mechanism including a weft yarn guide which is movably mounted to displace an associated one of the at least first and second weft yarns between a selected position, in which the yarn receiving end of the needle is adapted to engage the associated weft yarn as the needle moves across the shed opening to carry the associated weft yarn across the shed, and a standby position, in which the associated yarn remains on a first side of the shed in a position between the needle and the guard as the needle moves across the shed opening;

(b) activating the selection mechanism for the first weft yarn and engaging the first weft yarn with the yarn receiving end of the needle to carry the first weft yarn across the shed to a second side of the shed;

(c) engaging the first weft yarn with a stitching yarn on the second side of the shed and returning the needle to the first side of the shed, carrying the first yarn out of the shed;

(d) activating the selection mechanism for the second weft yarn and engaging the second weft yarn with the yarn receiving end of the needle to carry the second weft yarn across the shed to a second side of the shed; and (e) engaging the second weft yarn with the stitching yarn on the second side of the shed and returning the needle to the first side of the shed, carrying the second yarn out of the shed.

15. The method of claim 14 further comprising weaving the weft yarns of the first group with the warp yarns in alternate sheds from the weft yarns of the second group.

* * * * *